US007216481B2

(12) United States Patent
MacBain et al.

(10) Patent No.: US 7,216,481 B2
(45) Date of Patent: May 15, 2007

(54) METHOD AND APPARATUS FOR REGENERATION OF ENGINE EXHAUST AFTERTREATMENT DEVICES

(75) Inventors: John A. MacBain, Carmel, IN (US); Harry L. Husted, Kokomo, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/233,914

(22) Filed: Sep. 23, 2005

(65) Prior Publication Data

US 2007/0068143 A1 Mar. 29, 2007

(51) Int. Cl.
*F01N 3/00* (2006.01)

(52) U.S. Cl. ..... 60/286; 60/274; 60/287; 60/295; 60/297; 422/172; 422/182

(58) Field of Classification Search ..... 60/274, 60/275, 286, 287, 288, 295, 297, 303, 324; 123/1 A, 3 A, DIG. 12; 422/169, 171, 172, 422/177, 182
See application file for complete search history.

(56) References Cited

U.S. PATENT DOCUMENTS 6,560,958 B1 * 5/2003 Bromberg et al. ..... 60/275
6,775,973 B2 * 8/2004 Liu et al. ..... 60/301
6,845,610 B2 * 1/2005 Shiino et al. ..... 60/286
6,895,746 B2 * 5/2005 Buglass et al. ..... 60/286
6,955,042 B1 * 10/2005 Wnuck et al. ..... 60/286
6,976,353 B2 * 12/2005 Daniel et al. ..... 60/275
2005/0257516 A1 * 11/2005 Ancimer et al. ..... 60/286
2005/0274107 A1 * 12/2005 Liu et al. ..... 60/286
2006/0260297 A1 * 11/2006 Koch ..... 60/286

* cited by examiner

*Primary Examiner*—Tu M. Nguyen
(74) *Attorney, Agent, or Firm*—Paul L. Marshall

(57) ABSTRACT

An improved method and apparatus for providing reformate into an engine exhaust stream including aftertreatment devices such as a particulate trap and an NOx filter regenerable by hydrogen-rich reformate injected into the engine exhaust ahead of the aftertreatment devices. A pump pressurizes a hydrocarbon catalytic reformer, and a three-way valve for dividing the reformate injected into the engine exhaust. The reformer draws oxygen from the engine exhaust rather than ambient air as in the prior art. Thus, the only pressure drop that the pump/reformer system must overcome is within the reformate supply system between the reformer take-off point and the reformate entry points. In a configuration wherein the exhaust is taken off ahead of the inline particulate trap, a separate particulate filter is preferably incorporated into the reformer supply line.

17 Claims, 2 Drawing Sheets

METHOD AND APPARATUS FOR REGENERATION OF ENGINE EXHAUST AFTERTREATMENT DEVICES

TECHNICAL FIELD

The present invention relates to devices for exhaust aftertreatment for internal combustion engines; more particularly, to a mechanism for regenerating such aftertreatment devices that becomes fouled or loaded, in the case of traps, by exhaust through use; and most particularly, to method and apparatus for regeneration of an installed first aftertreatment device (AD1), for example, a diesel particulate filter (DPF) and a second aftertreatment device (AD2), for example, a nitrogen oxides (NOx) adsorber, using hydrogen-rich reformate generated by a catalytic hydrocarbon reformer.

BACKGROUND OF THE INVENTION

Exhaust aftertreatment devices for reducing emissions from internal combustion engines are well known. It is known in the diesel engine art to provide in series a plurality of exhaust aftertreatment devices, referred to herein for simplicity as AD1 and AD2. Especially in treatment of diesel engine exhaust, such devices are designed to collect or trap undesirable exhaust constituents such as particulates or NOx, becoming full over time. They may also become contaminated by exhaust constituents which inactivate the aftertreatment device chemically, such as sulfur, or physically, such as ash, which can cause clogging or other dysfunction from prolonged exposure to the exhaust stream. Thus, it is important to be able to clean, or "regenerate," inline exhaust amelioration devices as needed, while the engine is running.

It is further known in the prior art to provide a catalytic hydrocarbon reformer for generating hydrogen-rich reformate which is added to the engine exhaust stream upstream of the aftertreatment devices. The hydrogen attacks and removes deposits in the devices. In a typical cleaning duty cycle for an 8-cylinder light duty diesel vehicle, reformate is introduced into the exhaust stream for approximately 10 seconds, followed by approximately 70 seconds of little or no reformate. Typically, about 20 grams per second of reformate is needed for adequate regeneration.

In a prior art arrangement, the reformer takes in hydrocarbon fuel and fresh air to produce the reformate. To inject this reformate into the exhaust stream ahead of the aftertreatment devices requires that the pressure of the reformate be higher than the exhaust backpressure, $P_{engine}$, at all speeds and loads, so that the reformate will flow into the exhaust stream. The apparatus must include a pump to raise the pressure of the reformate output stream to a pressure of approximately 80–100 kPa above ambient pressure, $P_{ambient}$, which is the nominal inlet air pressure for the engine and the reformer, to overcome the exhaust backpressure. If the pump is 80% efficient, for example, an electric motor of about 1.5 kW input is required to run the pump. This size electric motor is large, expensive, and not practically powered by conventional 12–14 volt electrical systems provided in typical vehicles.

What is needed in the art is an improved method and apparatus for providing reformate into an engine exhaust stream which reduces the required size of the pump and pump motor.

It is a principal object of the present invention to reduce the pressure head against which a reformate pump must operate, thereby reducing the required size of the pump and pump motor.

SUMMARY OF THE INVENTION

Briefly described, a method and apparatus in accordance with the invention for providing reformate into the exhaust stream of a gasoline (spark-ignited) or diesel (compression-ignited) internal combustion engine by means which reduces the required size of the reformate pump and pump motor for pressurizing a hydrocarbon catalytic reformer and a distribution valve for dividing the reformate output of the reformer and sending it to a plurality of different points in the engine exhaust stream. The engine exhaust system includes a plurality of aftertreatment devices such as a particulate trap and an NOx filter. The chosen reformer is effective with an oxidizing input comprising oxygen-depleted engine exhaust rather than ambient air, for reaction with hydrocarbon fuel. The reformer draws its oxidizing intake from the engine exhaust at exhaust line pressure and discharges its reformate back into the engine exhaust at any of several locations. Thus, the only pressure drop that the pump must overcome is that within the reformate supply system between the reformer take-off point and the reformate entry point. In a configuration wherein the exhaust is taken off ahead of the inline particulate trap, a separate particulate filter is preferably incorporated into the reformer supply line.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
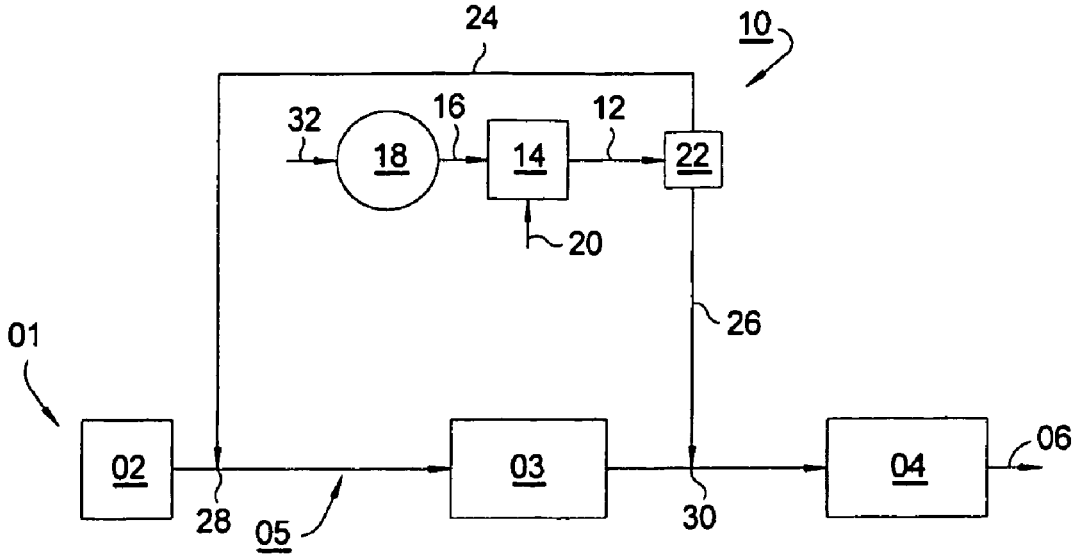
FIG. 1. (PRIOR ART)
FIG. 1 is a schematic drawing of a prior art apparatus configuration for supplying reformate to an engine exhaust system including first and second aftertreatment devices AD1 and AD2.

Referring to FIG. 1, an exhaust system for an internal combustion engine 01 such as, for example, a diesel engine 02, includes a first exhaust aftertreatment device 03 (AD1) comprising a diesel particulate filter (DPF) and in series a second exhaust aftertreatment device 04 (AD2) comprising a nitrogen oxides adsorber. The exhaust system may further include mufflers, resonators, oxidation catalysts, and/or other exhaust components know in the art. An exhaust pipe 05, or any other means for communicating gas flow, runs from engine 01 through devices 03,04 to a tailpipe 06.

In a prior art arrangement 10 for providing hydrogen-rich reformate 12 to exhaust pipe 05 for regeneration of AD1 and AD2, a source of reformate 14, such as a catalytic hydrocarbon reformer, is supplied with fresh air 16 by a gas pump 18, and with metered hydrocarbon fuel 20, to form reformate 12 which is directed to a controllable splitter valve 22. Valve 22 divides the flow of reformate 12 into first and second streams 24, 26 which are directed into exhaust pipe 05 at point 28 ahead of AD1, and at point 30 ahead of AD2, respectively. Air 32 entering pump 18 is at ambient pressure, $P_{ambient}$.

As noted above, a serious problem with prior art arrangement 10 is that an undesirably large pump motor and high-efficiency pump 18 is required to overcome high backpressure encountered for injecting reformate into exhaust line 05. This may be quantified as follows, where $\Delta P_{pump}$ is the increase in air pressure required of pump 18:

$$\Delta P_{pump} > P_{engine} - P_{ambient} = ca.\ 80\text{–}100\ \text{kPa} \quad \text{(Eq. 1)}$$

Figure 2:
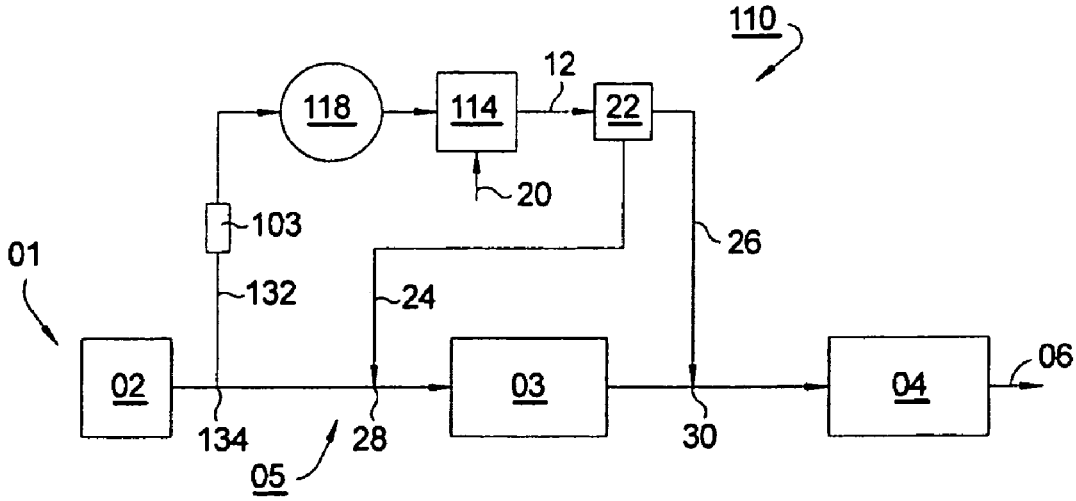
FIG. 2 is a schematic drawing of a first embodiment of an apparatus configuration in accordance with the invention for supplying reformate to an engine exhaust system including first and second aftertreatment devices AD1 and AD2.

Referring to FIG. 2, in an improved arrangement 110 for providing reformate to an engine exhaust system, the engine and exhaust aftertreatment components are as in the prior art. Also, as in the prior art, a pump supplies reforming oxygen to a reformate source from which the reformate stream is split by valve 22 into two streams 24,26 which enter exhaust pipe 05 at points 28 and 30, respectively.

The improvement in arrangement 110 is that the reforming oxygen supply 132 is drawn from pressurized engine exhaust in exhaust pipe 05 at point 134 upstream of point 28, rather than from ambient air as in the prior art, thus reducing the pressure differential that the pump must produce and allowing use of a much smaller motor and pump 118 than prior art pump 18. Engine exhaust, especially diesel exhaust, contains a substantial percentage of oxygen which may be employed in reforming fuel 20, although a different reformate source 114 may be required that is effective with an input that is oxygen-depleted engine exhaust rather than ambient air 32 in FIG. 1. Also, because supply 132 is taken off ahead of particulate filter 03, a small inline particulate filter 103 is preferred to keep fouling particulates out of reformate source 114. In use, filter 103 would be scheduled for change at regular maintenance intervals.

Embodiment 110 offers the lowest pressure differential possible for pump 118, as the pump must overcome only the pressure drop across filter 103 ($\Delta P_{filter}$), reformate source 114 ($\Delta P_{reformer}$) and valve 22 ($\Delta P_{valve}$) to inject reformate at point 28 for regeneration of aftertreatment device 03 (AD1):

$$\Delta P_{pump} > \Delta P_{filter} + P_{reformer} + \Delta P_{valve} \quad \text{(Eq. 2)}$$

For regeneration of aftertreatment device 04 (AD2), the pump pressure difference is even lower, as the back pressure against which the pump must operate in injecting reformate at point 30 is reduced by the pressure drop across AD1 03, ($\Delta P_{AD1}$).

$$\Delta P_{pump} > (\Delta P_{filter} + P_{reformer} + \Delta P_{valve}) - \Delta P_{AD1} \quad \text{(Eq. 3)}$$

Figure 3:
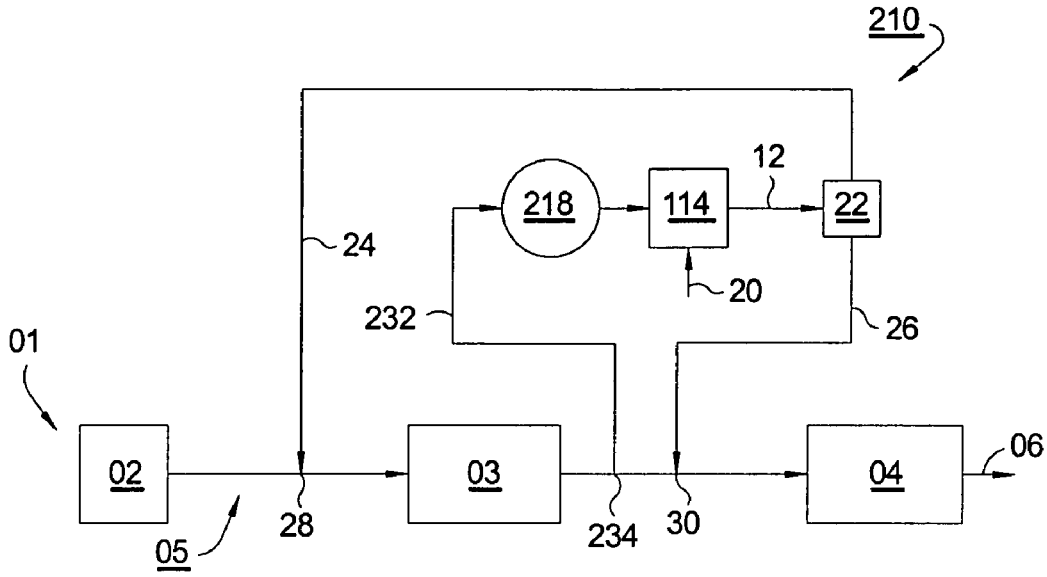
FIG. 3 is a schematic drawing of a second embodiment of an apparatus configuration in accordance with the invention for supplying reformate to an engine exhaust system including first and second aftertreatment devices AD1 and AD2.

Referring to FIG. 3, in a second improved arrangement 210 for providing reformate to an engine exhaust system, the engine and exhaust aftertreatment components are as in the prior art. Also, a pump supplies reforming oxygen to a reformate source, from which the reformate stream is split by valve 22 into two streams 24,26 which enter exhaust pipe 05 at points 28 and 30, respectively.

The improvement in arrangement 210 is that the reforming oxygen supply 232 is drawn from pressurized engine exhaust in exhaust pipe 05 at point 234 between AD1 and AD2. Because supply 132 is taken off downstream of particulate filter 03, inline particulate filter 103 is not needed in this embodiment.

Embodiment 210 offers the next lowest pressure differential possible for pump 118. This embodiment has the disadvantage that the pump pressure difference is higher than in embodiment 110 by the amount equal to the pressure difference across AD1 03. The pump must overcome not only the pressure drop across reformate source 114 ($\Delta P_{reformer}$) valve 22 ($\Delta P_{valve}$), but also the pressure drop across AD1 ($\Delta P_{AD1}$) to inject reformate at point 28 for regeneration of aftertreatment 03 (AD1):

$$\Delta P_{pump} > \Delta P_{reformer} + \Delta P_{valve} + \Delta P_{AD1} \quad \text{(Eq. 4)}$$

However, for regeneration of aftertreatment device 04 (AD2), the pump pressure difference is even lower than in embodiment 110, as the backpressure against which the pump must operate in injecting reformate at point 30 is only the pressure drop across the reformer ($\Delta P_{reformer}$) and the valve ($\Delta P_{valve}$).

$$\Delta P_{pump} > \Delta P_{reformer} + \Delta P_{valve} \quad \text{(Eq. 5)}$$

It will be seen by one of ordinary skill in the art that a third configuration (not shown) is possible wherein the exhaust feed to the pump is taken from tail pipe 06. However, because the exhaust backpressure in the tailpipe is very nearly $P_{ambient}$, such an embodiment offers little advantage over the prior art arrangement 10 shown in FIG. 1.

Sufficient amounts of oxygen must be present in the exhaust stream to produce reformate by the reformate source. On the other hand, for successful particulate filter regeneration, no or a minimal amount of oxygen should be present in the exhaust stream during the regeneration cycle. Therefore, a means is provided, as shown in FIG. 4, to assure that reformate will be available for particulate filter regeneration when the exhaust composition is suitable for filter regeneration (that is, when the exhaust contains no or a minimal amount of oxygen such as during rich engine operation).

Figure 4:
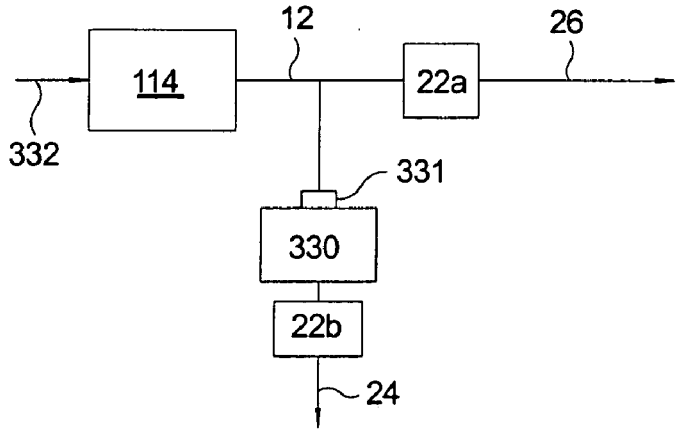
FIG. 4 is a schematic drawing of an apparatus configuration in accordance with the invention including a reformate storage vessel.

Referring to FIG. 4, reformate storage vessel 330 is shown in flow communication between reformate source 114 and stream 24 directed toward the particulate filter (shown in FIGS. 2 and 3). Vessel 330 includes one-way check valve 331. Valves 22*a* and 22*b* are also provided. In operation, reformate 12 is generated by reformate source 114 during normal diesel engine operation when sufficient oxygen is present in the engine's exhaust as feed stock to the reformate source. Reformate 12, produced by reformate source 114 from oxygen laden engine exhaust 332, is fed to the nitrogen oxides adsorber (shown in FIGS. 2 and 3) via stream 26 through control valve 22*a* for regeneration of the adsorber as needed, as in embodiments 110 and 210.

Reformate 12 produced by reformate source 114 is also fed to vessel 330 where it is stored until needed to regenerate the particulate filter via stream 24. Reformate 12 stored in vessel 330 may then be selectively fed by control valve 22*b* to the particulate filter for regeneration only when minimal or no oxygen is present in the engine exhaust (such as during rich engine operation).

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A method for providing reformate into an exhaust stream of an internal combustion engine, comprising the steps of:

a) providing a reformate source;

b) providing hydrocarbon fuel to said reformer;

c) diverting a portion of said exhaust stream into said reformate source using a pump disposed downstream of said engine to produce said reformate by partially oxidizing said hydrocarbon fuel; and d) directing said reformate from said reformate source into the remainder of said exhaust stream.

2. A method for regenerating an exhaust stream aftertreatment device disposed in an exhaust stream of an internal combustion engine, comprising the steps of:

a) providing a reformate source for supplying hydrogen-rich reformate;

b) connecting an outlet of said reformate source to said exhaust stream at a first point ahead of said exhaust aftertreatment device to inject said reformate into said exhaust aftertreatment device;

c) connecting an outlet of a pump to an inlet of said reformate source to provide oxygen to said reformate source; and d) connecting an inlet of said pump to said exhaust stream at a second point between said engine and said first point to divert a portion of said exhaust stream containing oxygen through said pump to said reformate source.

3. A method in accordance with claim 2 comprising the further step of operating said pump and said reformer on a predetermined schedule.

4. A system for supplying reformate into an exhaust stream extending from an internal combustion engine, comprising:

a) a reformate source supplied with fuel and oxygen for generating said reformate;

b) a reformate connector for providing reformate from said reformate source to an entry point into said exhaust stream, wherein said oxygen supplied to said reformate source is a component of a portion of said exhaust stream supplied from said exhaust stream to said reformate source; and c) a pump for receiving said portion of said exhaust stream containing said oxygen component and supplying said oxygen component to said reformate source.

5. A system in accordance with claim 4 wherein said engine is selected from the group consisting of spark-ignited and compression-ignited.

6. A system in accordance with claim 4 wherein said exhaust stream of said internal combustion engine is passed through a first exhaust aftertreatment device, wherein said oxygen is supplied to said reformate source via an oxygen connector, and wherein said oxygen connector and said reformate connector are connected to said exhaust stream at respective points between said engine and said first exhaust aftertreatment device.

7. A system in accordance with claim 1 further comprising a storage vessel in flow communication between said reformate source and said first exhaust aftertreatment device.

8. A system in accordance with claim 4 further comprising a filter for receiving said portion of said exhaust stream prior to entering said reformate source.

9. A system in accordance with claim 8 wherein said filter for receiving said portion of said exhaust stream prior to entering said reformate source is a particulate filter.

10. A system in accordance with claim 4 further comprising a valve between said reformate source and said exhaust stream for dividing said reformate into first and second sub-streams.

11. A system in accordance with claim 10 further comprising a storage vessel in flow communication between said reformate source and said first exhaust aftertreatment device, wherein said storage vessel is disposed in at least one of said first and second sub-streams.

12. A system in accordance with claim 11 wherein said first and second sub-streams are in parallel flow.

13. A system in accordance with claim 10 wherein said valve includes a splitter valve and first and second valve connectors connected to said exhaust stream for providing said first and second reformate sub-streams into said exhaust stream.

14. A system in accordance with claim 13 wherein said exhaust stream of said internal combustion engine is passed through a first exhaust aftertreatment device and a second exhaust aftertreatment device, and wherein said oxygen connector is connected to said exhaust stream between said engine and said first exhaust aftertreatment device, and wherein said first valve connector is connected to said exhaust stream between said engine and said first exhaust aftertreatment device, and wherein said second valve connector is connected to said exhaust stream between said first and second exhaust aftertreatment devices.

15. A system in accordance with claim 14 wherein said first exhaust aftertreatment device includes a particulate trap and wherein said second exhaust aftertreatment device includes a nitrogen oxides filter.

16. An internal combustion engine comprising a system for supplying a stream of reformate into an exhaust stream extending from the engine, said system including a reformate source supplied with fuel and oxygen for generating said reformate, a reformate connector for providing reformate from said reformate source to an entry point into said exhaust stream, wherein said oxygen supplied to said reformate source is a component of a portion of said exhaust stream supplied from said exhaust stream to said reformate source, and a pump for receiving said portion of said exhaust stream containing said oxygen component and supplying said oxygen component to said reformate source.

17. A system for supplying reformate into an exhaust stream extending from an internal combustion engine, comprising:

a) a reformate source supplied with fuel and oxygen for generating said reformate, said oxygen supplied to said reformate source is a component of a portion of said exhaust stream supplied from said exhaust stream to said reformate source;

b) a pump for supplying said oxygen component to said reformate source;

c) a filter for receiving said portion of said exhaust stream prior to entering said reformate source; and d) a reformate connector for providing reformate from said reformate source to an entry point into said exhaust stream.

* * * * *